US005912688A

United States Patent [19]

Gragg

[11] Patent Number: 5,912,688

[45] Date of Patent: Jun. 15, 1999

[54] SPRING BAG BASED, OFF AXIS INK DELIVERY SYSTEM AND PUMP TRIGGER

[75] Inventor: Brian D. Gragg, San Diego, Calif.

[73] Assignee: Hewlett-Packard Company, Palo Alto, Calif.

[21] Appl. No.: 08/538,685

[22] Filed: Oct. 2, 1995

[51] Int. Cl.[6] ..... B41J 2/175

[52] U.S. Cl. ..... 347/86

[58] Field of Search ..... 347/84–87, 6, 347/7, 89

[56] References Cited

U.S. PATENT DOCUMENTS

| | | | |
|---|---|---|---|
| 4,223,323 | 9/1980 | Bader et al. | 347/85 |
| 4,422,084 | 12/1983 | Saito | 347/7 |
| 4,500,895 | 2/1985 | Buck et al. | 347/87 |
| 4,714,937 | 12/1987 | Kaplinsky | 347/86 |
| 4,831,389 | 5/1989 | Chan | 347/86 |
| 4,929,963 | 5/1990 | Balazar | 347/89 |
| 4,959,667 | 9/1990 | Kaplinsky | 347/87 |
| 4,967,207 | 10/1990 | Ruder | 347/7 |
| 4,968,998 | 11/1990 | Allen | 347/7 |
| 4,970,528 | 11/1990 | Beaufort et al. | 346/25 |
| 4,977,413 | 12/1990 | Yamanak et al. | 347/7 |
| 5,121,132 | 6/1992 | Pan et al. | 347/87 |
| 5,136,305 | 8/1992 | Ims | 347/7 |
| 5,280,300 | 1/1994 | Fong et al. | 347/87 |
| 5,359,353 | 10/1994 | Hunt et al. | 347/86 |
| 5,367,328 | 11/1994 | Erickson | 347/7 |
| 5,369,429 | 11/1994 | Erickson | 347/7 |

*Primary Examiner*—N. Le
*Assistant Examiner*—L. Anderson

[57] ABSTRACT

An off-axis spring bag ink delivery system for an ink-jet printer/plotter. An auxiliary ink reservoir is located off-axis, and is coupled to an internal ink cartridge spring bag reservoir through a tube and check valve. A sensor determines when ink is to be pumped from the auxiliary reservoir into the interval reservoir. Ink does not flow from the auxiliary reservoir to the internal reservoir unless the check valve break pressure is exceeded, when the ink is being actively pumped in response to the sensor indication. The sensor can be a leaf spring switch built into the ink cartridge, which opens when the spring bag collapses beyond a leaf spring set point. The sensor can also be a pressure switch responsive to the negative pressure within the internal reservoir, which activates the auxiliary reservoir pump when the magnitude of the negative pressure exceeds a set pressure magnitude, indicating the cartridge reservoir ink volume is low.

35 Claims, 3 Drawing Sheets

SPRING BAG BASED, OFF AXIS INK DELIVERY SYSTEM AND PUMP TRIGGER

TECHNICAL FIELD OF THE INVENTION

The invention relates to ink-jet printers/plotters, and more particularly to a spring-bag ink-jet cartridge and off-axis ink delivery system.

BACKGROUND OF THE INVENTION

Thermal ink-jet (TIJ) printers and plotters typically include a TIJ pen cartridge which includes a reservoir of ink coupled to the TIJ print head. One type of cartridge includes a polymer foam disposed within the print reservoir so that the capillary action of the foam will prevent ink from leaking or drooling from the print head. In such a foam cartridge, an air-vented delivery system is provided wherein air enters the reservoir via a separate vent opening to replace ink which is dispensed from the reservoir through the print head.

A different type of TIJ cartridge has an ink reservoir which is ordinarily maintained under a sub-atmospheric or negative pressure so that ink will not leak or drool from the print head. Various types of ink reservoirs may be used including refillable ink reservoir cartridges which are mounted on the moveable printer carriage, throwaway replaceable cartridges which are mounted on the printer carriage, and remote or off-board ink reservoirs from which ink is brought to the print head on the printer carriage by tubing.

A collapsible ink reservoir for an ink-jet printer is disclosed in U.S. Pat. No. 4,422,084, issued Dec. 20, 1983, to Saito. Negative pressure is maintained in a polypropylene ink bag by various types of springs which bias the bag walls apart from each other. The springs may be mounted inside of or externally of the ink bag, but the spring pressure regulator construction does not result in substantially complete emptying of the ink bag and the bag itself is not carried on a printer carriage.

Another ink reservoir which achieves constant negative back pressure through an external spring or an elastomeric bladder is disclosed in U.S. Pat. No. 4,509,062, issued Apr. 2, 1985.

An ink-printer marketed as the Canon BJ800 printer had an off-axis reservoir connected to an ink separator by a tubing, which was connected to an ink cartridge. The printer relied on the negative pressure in the cartridge and air accumulator to draw ink from the off-axis reservoir to the print cartridge. A pump, used to pull air from the air accumulator and to prime the print head, may cause some ink to move through the tubing into the air separator.

Large format ink-jet printer/plotters such as the DESIGNJET series sold by Hewlett-Packard Company offer substantial improvements in speed over the conventional X-Y vector plotter. Ink-jet printer/plotters typically include a plurality of print cartridges, each having a print head with an array of nozzles. The cartridges are mounted in a carriage which is moved across the page in successive swaths. Each ink-jet print head has heater circuits which when activated cause ink to be ejected from associated nozzles. As the cartridge is positioned over a given location, a jet of ink is ejected from the nozzle to provide a pixel of ink at a desired location. The mosaic of pixels thus created provides a desired composite image.

Recently, full color ink-jet printer/plotters have been developed which comprise a plurality of ink-jet cartridges of diverse colors. A typical color ink-jet printer/plotter has four ink-jet print cartridges, one for black ink (K), and three for color inks, magenta (M), cyan (C) and yellow (Y). The colors from the three color cartridges are mixed to obtain a full spectrum of color. The cartridges are typically mounted in stalls within an assembly which is mounted on the carriage of the printer/plotter. The carriage assembly positions the ink-jet cartridges and typically holds the circuitry required for interface to the heater circuits in the ink-jet cartridges.

Large scale printer/plotters have been developed which use cartridges with internal spring-bag reservoirs. Because of the volume of ink used in creating many plots, as well as the heavy usage to which the devices are put, the user must intervene to replace cartridges whose internal reservoirs have been depleted of ink. This can lead to expensive waste if a large scale plot is commenced, but must be discarded because one or more of the cartridges runs out of ink. The print media on which such plots are made is typically relatively expensive. Moreover, time is lost in commencing a large plot only to have to discard the plot because one of the cartridges runs out of ink before the plot is finished.

Thus, there is a need in the art for systems and techniques for providing an increased supply of ink in printer/plotters employing negative pressure cartridges.

SUMMARY OF THE INVENTION

An off-axis spring-bag ink delivery system is described, including a cartridge with a print head for ejecting droplets of ink in a controlled fashion to produce an image on a recording medium, and an internal closed spring bag reservoir for holding an internal supply of liquid ink under negative pressure. The reservoir includes a movable side wall and an internal spring for biasing the side wall against collapsing as ink is withdrawn from the reservoir and ejected from said print head during printing operations. The system has an off-axis auxiliary ink reservoir for holding an auxiliary supply of liquid ink. An active pump system pumps ink from the auxiliary ink reservoir under positive pressure upon receipt of a pump trigger signal. A tubing system provides a fluid path between the spring bag reservoir and the auxiliary reservoir.

The system further includes a check valve disposed in the fluid path between the spring bag reservoir and the auxiliary reservoir, the check valve responsive to a differential ink pressure to allow ink to flow through the valve only if the differential ink pressure exceeds a predetermined valve break pressure, and prevents ink flow through the valve when the differential ink pressure is below the valve break pressure. A pump trigger apparatus produces a pump trigger signal to activate the pump when the internal supply of ink is low, thereby causing ink to be pumped through from the reservoir through the tubing system and check valve to refresh the internal supply of ink within the spring bag reservoir.

In one embodiment, the pump trigger apparatus includes a pressure switch responsive to the negative pressure of the spring bag reservoir to activate the pump when the magnitude of the negative pressure exceeds a preset pressure The pressure switch is disposed in line in the tubing system between the spring bag reservoir and the check valve.

In another embodiment, the pump trigger apparatus includes a switch disposed within the ink cartridge, the switch responsive to the relative position of the movable side wall to change switch status when the movable side wall position changes as a result of ink depletion from the internal reservoir to a low ink supply position. The switch is a leaf spring switch comprising an electrically conductive region defined on the side wall, and a pair of electrically conductive leaf springs having contact end regions which bear against the conductive region when the internal reservoir is at least partially full. The leaf spring contact end regions break contact with the conductive region when the side wall position reaches the low ink supply region. The trigger signal is represented by the leaf spring switch open status.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE PREFERRED EMBODIMENT

Figure 1:
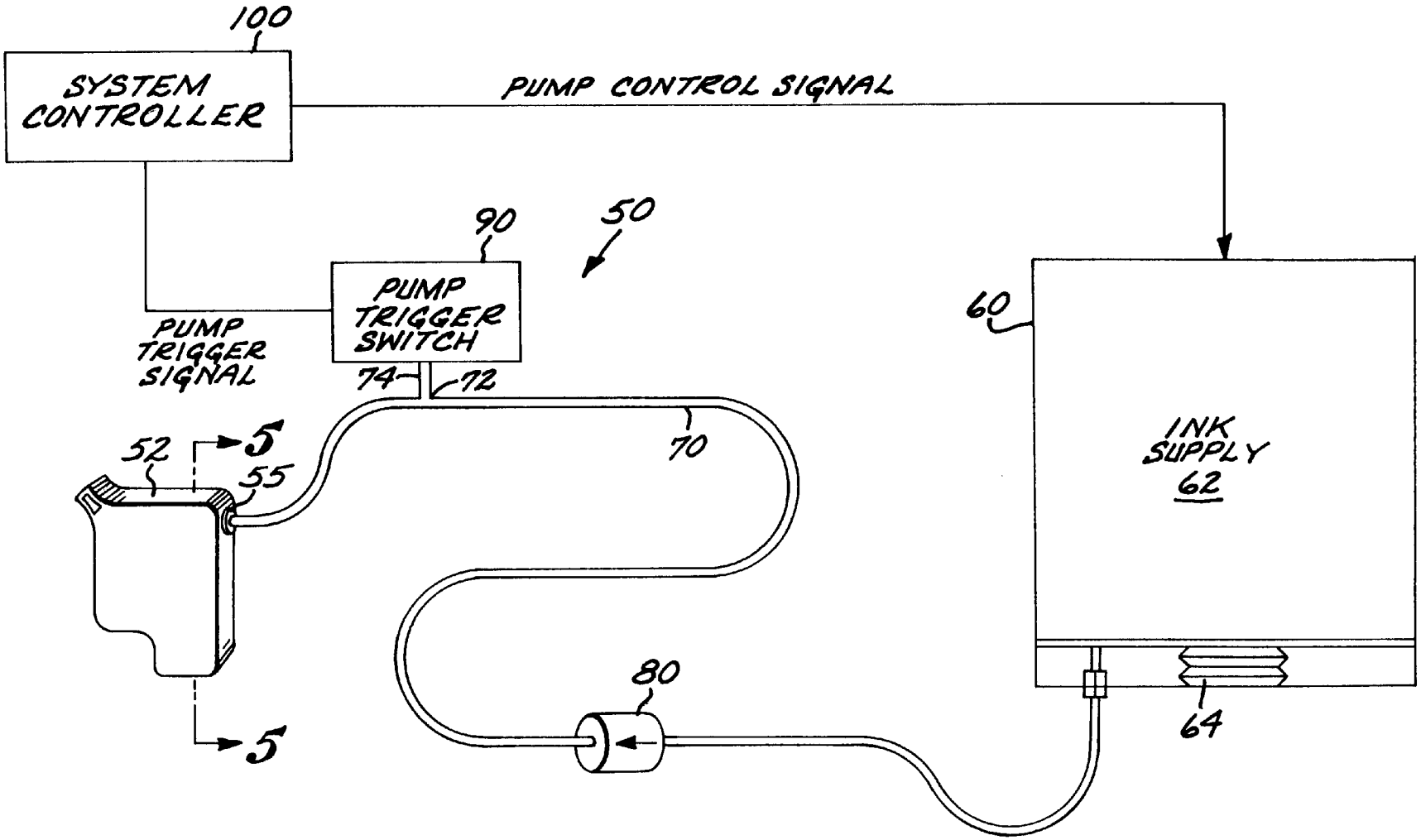
FIG. 1 is a schematic diagram of a preferred embodiment of a spring bag ink delivery system with an off-axis auxiliary reservoir in accordance with the invention.

FIG. 1 is a simplified schematic diagram of a preferred embodiment of a spring bag ink delivery system 50 with an off-axis auxiliary reservoir for a printer/plotter. In this exemplary embodiment, a spring bag ink delivery system in the form of an ink-jet cartridge 52 is connected to an off-axis auxiliary ink supply/pump system 60 comprising an ink bag 62 and a pump 64. An exemplary auxiliary ink supply pump system suitable for the purpose is described in application Ser. No. 08/429,915, filed Apr. 27, 1995, entitled INK SUPPLY FOR AN INK-JET PRINTER, by B. Cowger et al., now U.S. Pat. No. 5,825,376 the entire contents of which are incorporated herein by this reference. While diaphragm or bellows-type pumps, or other types of pumps can be employed, the particular details of the pump is not a feature of this invention.

The internal spring bag reservoir of the cartridge 52 is connected to the ink supply/pump system 60 by a tubing system 70. The internal reservoir includes a movable side wall and a spring for biasing the side wall against collapsing as ink is withdrawn from the internal reservoir during printing operations. In a preferred embodiment illustrated in U.S. Pat. No. 5,426,459, the entire contents of which are incorporated herein by reference, the internal reservoir is defined by a pair of film membranes, each constituting a movable side wall. The bias spring biases apart two side plates, which bear against the film membranes. As ink is depleted, the side plates are drawn toward each other against the spring bias, the spring tending to keep the plates and membranes apart, thereby creating the negative pressure.

Figure 5:
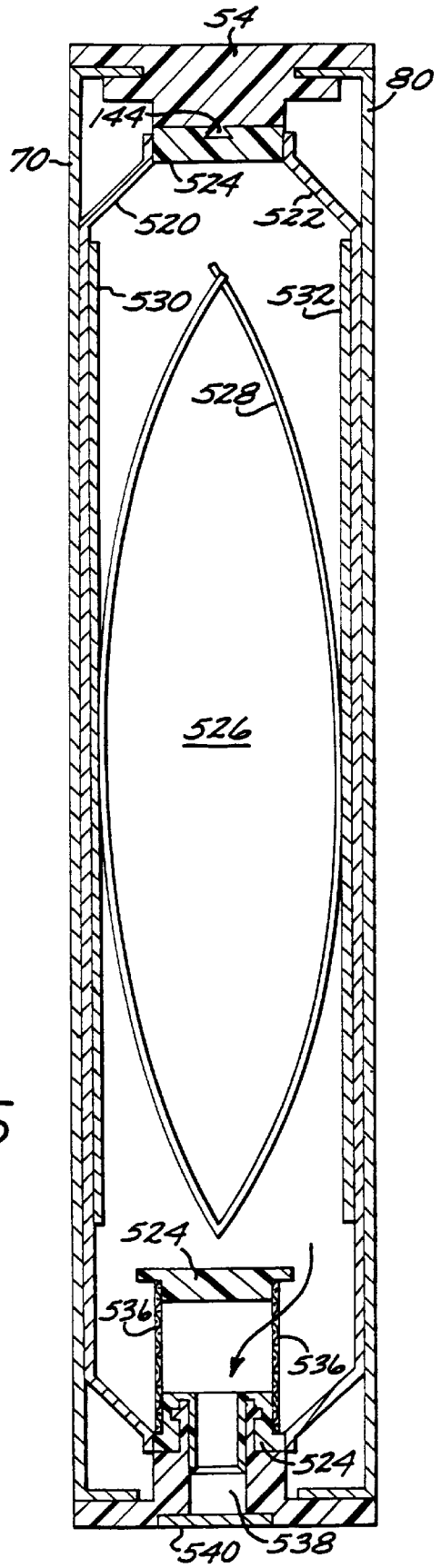
FIG. 5 is a cross-sectional view of a spring-bag ink-jet cartridge used in the system of FIG. 1.

FIG. 5 is a cross-sectional view taken through the cartridge 52 of FIG. 1, showing the external frame structure 54 of the cartridge, the interior frame member 524 to which the film membranes 520 and 522 are attached to define the internal ink reservoir 526, and the bias spring 528 which separates the rigid side plates 530 and 532. During printing operations, ink flows from the ink reservoir 526 through a pair of fine mesh filters 536 in the direction of the flow arrows, and through a channel 538 to ink-jet print head 540, where the ink is ejected in the form of finely controlled droplets.

The tubing system 70 can be connected to the internal spring bag reservoir through an ink fill port 55 extending through the frame of the cartridge. Commonly assigned application Ser. No. 08/454,975, now issued as U.S. Pat. No. 5,745,137 filed May 31, 1995, entitled CONTINUOUS REFILL OF SPRING BAG RESERVOIR IN AN INK-JET SWATH PRINTER/PLOTTER, by J. Scheffelin et al., and 08/455,478, now issued as U.S. patent, filed May 31, 1995, entitled INK-JET SWATH PRINTER WITH AUXILIARY INK RESERVOIR, by J. Bohorquez et al., describe in further detail exemplary tubing connections between the spring bag reservoir and auxiliary reservoirs, the entire contents of which are incorporated herein by reference. The auxiliary reservoir preferably is a bag, e.g., as described in the foregoing referenced patent applications.

A check valve 80 is disposed in the tubing system between the internal cartridge reservoir and the auxiliary reservoir system 60. The check valve has a break pressure, say between 9 and 15 inches of water (or so) in this example. As a result, ink will not flow from the auxiliary reservoir system 60 to the cartridge reservoir unless the check valve 80 sees a pressure of more than 9 to 15 inches of water across it. In the typical mode of operation, this would only happen when the pump 64 is activated. In an exemplary embodiment, the pump 64 supplies ink at a pressure of 27 inches of water, or 1 psi. Check valves suitable for the purpose can be purchased commercially. The check valve provides the function of keeping ink from flowing into the spring bag reservoir unless the pump 64 is actively operating to pump ink under pressure.

To determine when to pump the ink from the auxiliary reservoir, a vacuum pressure switch 90 is connected to a T 72 in the tubing system 70 between the internal spring bag reservoir and the check valve 80. Since the check valve does not open until the pressure of more than 9 to 15 inches of water is applied, the pressure switch 90 is essentially responding to the negative pressure within the internal reservoir of the cartridge 52. As ink is depleted from the spring bag internal reservoir, the negative pressure will increase in magnitude; i.e., the pressure will become increasingly negative. When the pressure drops, i.e., becomes more negative, the vacuum switch 90 is triggered. This indicates a need for refilling the spring bag reservoir.

Figure 2:
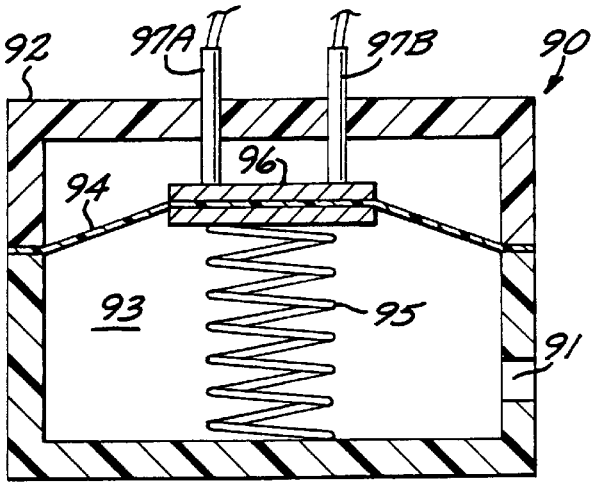
FIG. 2 is a schematic block diagram of a diaphragm vacuum switch useful for the system of FIG. 1.

The vacuum switch 90 can be a simple diaphragm, spring, and contact arrangement. FIG. 2 is a simplified schematic diagram of an exemplary embodiment of the diaphragm vacuum switch. The switch includes a housing 92 shown in cross-section, defining an internal chamber 93. A flexible diaphragm 94 closes off an end of the chamber, and is impervious to ink and air. A tube port 91 is formed through the housing wall into the chamber 93, and is connected to a branch 74 of the tubing system 70 to permit ink to enter into and fill the chamber 93. A spring 95 biases the diaphragm 94 upward. A conductive plate 96 is attached to a surface of the diaphragm opposed to the spring. Probes 97A and 97B extend through the housing wall a given distance. Normally, the spring will bias the diaphragm plate 96 against the probes, electrically shorting the two probes together. When pressure in the ink tubing system 70 gets low enough (i.e., high vacuum), the spring will be compressed and the conductive plate 96 will be pulled away from contact with the probes. The circuit will then open, and the resulting pump trigger signal is sensed by the system controller 100 which turns the pump 64 on.

In this exemplary embodiment, the controller 100 operates the pump 64 upon receipt of the pump trigger signal to pump a predetermined quantity of ink from the auxiliary reservoir to the cartridge spring bag reservoir. While the controller could alternatively cycle the pump on/off in response to each change in state of the pump trigger signal, this would result in many pump cycles of short duration. For an exemplary bellows-type or diaphragm pump, wherein the bellows diaphragm chamber holds one cc of ink, the pump could be automatically actuated by the controller 100 to make 20 strokes to deliver 20 cc of ink to the spring bag. Under normal or even heavy usage, this quantity of ink will last for some time, so that frequent, repetitive cycling of the pump 64 will be avoided. Of course, other predetermined quantities of ink can be employed in a given application.

Figure 3:
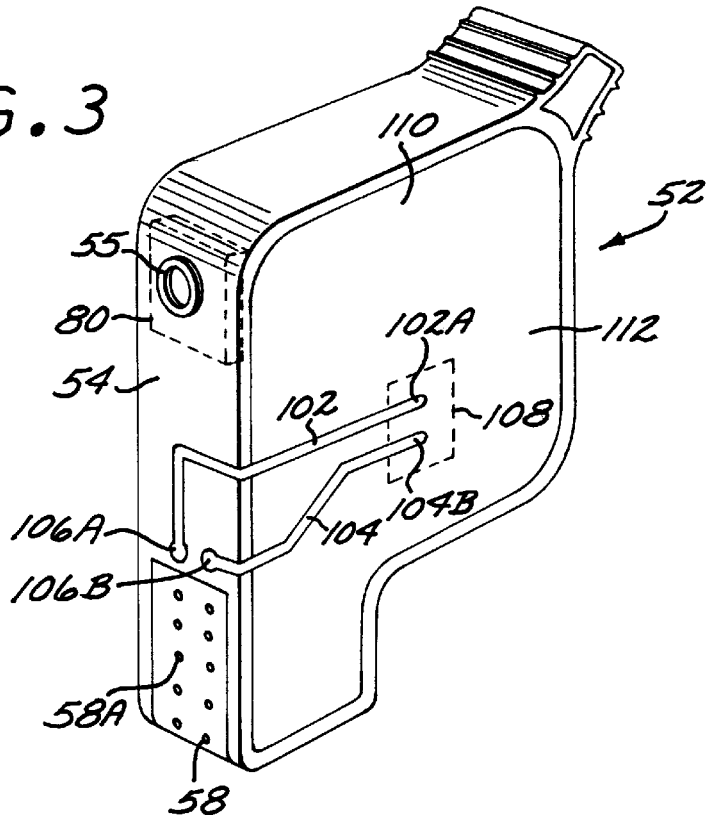
FIG. 3 illustrates an alternate embodiment of a pump trigger switch for the spring bag ink delivery system.

In an alternate embodiment, the vacuum switch 90 is replaced by a leaf spring switch comprising two leaf springs 102 and 104 built on the frame of the cartridge 52. An exemplary embodiment of the leaf spring switch is shown in FIGS. 3 and 4. The leaf springs 102 and 104 could be attached to the frame of the cartridge during manufacture, or insert molded into the part. Thus, in an exemplary embodiment of the spring bag cartridge, the frame includes a rigid outer peripheral loop member 54 fabricated of a rigid engineering plastic material, as described more fully in U.S. Pat. No. 5,426,459, for example. Ends 102A and 104A of the leaf springs 102 and 104 are secured adjacent an edge of the loop member 54. Contacts 106A and 106B are connected to the ends of the leaf springs to provide electrical connections to the leaf springs at the cartridge electrical interconnection circuit 58. The other ends 102B and 104B of the leaf springs contact a conductive patch 108 on the film 110 defining one flexible side wall of the internal spring bag reservoir 112. The leaf springs 102 and 104 are fabricated so as to apply minimum force to the spring bag film 110 (to keep from affecting its operation) and to only press against the bag film 110 for a given stroke length, i.e. until a predetermined quantity of ink has been depleted from the reservoir.

Figure 4A:
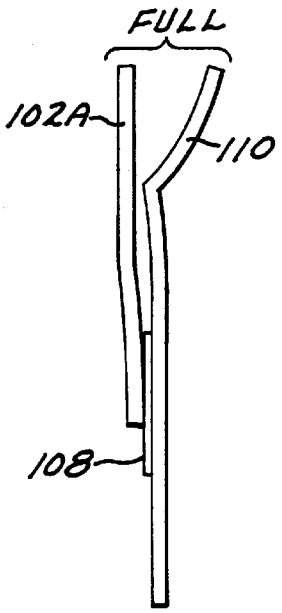
FIGS. 4A–4C are diagrammatic views, illustrating the operation of the leaf spring switch of the system of FIG. 3 for the respective spring bag full, partially full, and low conditions.
Figure 4B:
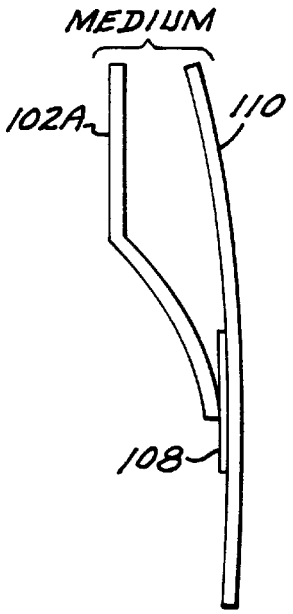
Figure 4C:
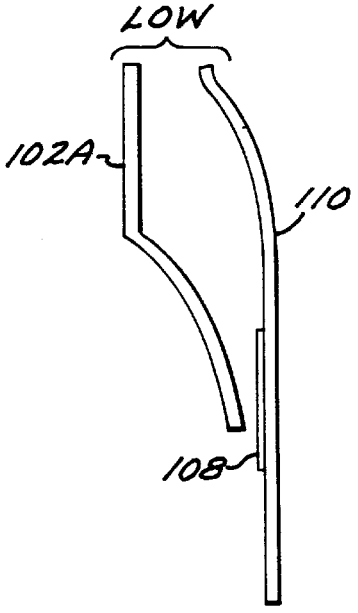

With the internal spring bag reservoir full of ink, as represented in FIG. 4A, the leaf springs 102 and 104 are in contact with the electrically conductive patch 108, thereby closing the leaf spring switch whose terminals are 106A and 106B. When the bag film 110 collapses beyond the leaf spring set point as ink is depleted from the internal reservoir, the leaf springs 102 and 104 will break contact with the patch 108. FIG. 4B shows a bag approximately one half full of ink. FIG. 4C shows the condition in which the ink has been depleted from the reservoir to the extent that the leaf springs have broken contact with the conductive patch 108. Using a leaf spring pair of elements 102 and 104, this break in contact can be electrically sensed by the controller 100. The two contacts 106A and 106B are routed around to the area just above the TAB interconnect circuit 58 and can be contacted by the same printer carriage interconnect circuit (not shown) that contacts the THA interconnect pads 58A. Whenever the contact between the leaf springs and the conductive patch 108 is broken, indicating the cartridge internal spring bag reservoir is low on ink, more ink can be pumped to the pen by the pump 64 as a result of the pump trigger signal provided by the open circuit condition between contacts 106A and 106B.

In another embodiment, three leaf spring contacts could alternatively be employed. One spring could be connected to the patch 108 to act as a common return, a second spring comes into contact with the conductive patch only when the internal spring bag reservoir is full, and a third leaf spring contact remains in contact with the patch 108 until the internal bag reservoir until the reservoir is depleted to a low condition. This arrangement can be used by the controller 100 to turn the pump on when the third spring contact is open circuited, and to continue pumping until the reservoir is full, indicated by the second spring contact making contact with the patch 108. This arrangement can provide feedback to the controller for the pumping operation.

In the alternate embodiment of FIG. 3, the check valve 80 can be placed within the ink-jet cartridge 50, as shown schematically in FIG. 3. In this embodiment, only the tubing system 70 is needed to provide the fluid connection to the auxiliary reservoir 60, thereby simplifying the system. The system controller 100 receives the pump trigger signal via the contacts 106A and 106B, and commands the auxiliary reservoir pump 64 to operate. Here again, the controller 100 preferably commands the pump to deliver a predetermined quantity of ink to the cartridge reservoir.

The check valve 80 can alternatively to be built into in the auxiliary ink reservoir/pump system 60 so that it is replaced if its life expectancy is an issue, or in the printer/plotter if life is not an issue, i.e. if the check valve is a long lasting product.

This invention provides several advantages. Spring bag cartridges can be used with an ink bag with the addition on only a few simple, cheap parts. The invention allows the same ink-jet cartridge to be used in stand-alone or off-axis configurations.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. An ink delivery system, comprising:

a cartridge including a print head for ejecting droplets of ink in a controlled fashion to produce an image on a recording medium, and an internal closed reservoir for holding an internal supply of liquid ink under negative pressure during printing operations;

an off-axis auxiliary ink reservoir for holding an auxiliary supply of liquid ink;

an active pump system to pump ink from the auxiliary ink reservoir under positive pressure upon command in response to an electrical pump trigger signal;

a tubing system connected between the internal reservoir and the auxiliary reservoir for providing a fluid path between the internal reservoir and the auxiliary reservoir;

a check valve disposed in the fluid path between the internal reservoir and the auxiliary reservoir, the check valve having an associated valve break pressure and responsive to a differential ink pressure and adapted to allow ink to flow through the valve from the auxiliary reservoir to the internal reservoir during printing operation only if the differential ink pressure across the check valve exceeds the valve break pressure, and to prevent ink flow through the valve from the auxiliary reservoir to the internal reservoir when the differential ink pressure is below the valve break pressure, the check valve preventing ink from flowing into the internal reservoir unless the pump system is actively operating to pump ink under pressure; and pump trigger apparatus for producing the electrical pump trigger signal to activate the pump system only when the internal supply of ink is low and to thereby pump ink from the auxiliary reservoir through the tubing system and check valve to replenish the internal supply of ink within the internal reservoir.

2. The system of claim 1 wherein the pump trigger apparatus includes a pressure switch responsive to a negative pressure of the internal reservoir to activate the pump system when a magnitude of the negative pressure exceeds a predetermined negative pressure magnitude.

3. The system of claim 2 wherein the pressure switch is connected to the tubing system between the internal reservoir and the check valve.

4. The system of claim 1 wherein the internal reservoir comprises a movable side wall, and the pump trigger apparatus includes electrical circuitry comprising a switch disposed within the ink cartridge, the switch responsive to a relative position of the movable side wall to change switch status when the movable side wall position changes as a result of ink depletion from the internal reservoir to a low ink supply position.

5. The system of claim 1 further including a controller responsive to the pump trigger signal to issue a pump control signal to the pump system.

6. The system of claim 5 wherein said controller is adapted to control said pump system to cause the pumping of a predetermined volume of ink from the auxiliary reservoir to the internal reservoir in response to receipt of the pump trigger signal, thereby avoiding frequent repetitive cycling of said pump system.

7. The system of claim 6 wherein the predetermined volume of ink substantially replenishes the volume of ink within the internal reservoir to a filled condition.

8. The system of claim 1 wherein the check valve break pressure is between 9 inches of water and 15 inches of water.

9. The system of claim 1 further including a supply of ink within said internal ink reservoir.

10. The system of claim 1 further including a supply of ink within said auxiliary reservoir.

11. A spring-bag ink delivery system, comprising:

a cartridge including a print head for ejecting droplets of ink in a controlled fashion to produce an image on a recording medium, and an internal closed spring bag reservoir for holding an internal supply of liquid ink under negative pressure during printing operations, said reservoir including a movable side wall and an internal spring for biasing said side wall against a collapsing force as ink is withdrawn from the reservoir and ejected from said print head during printing operations;

an off-axis auxiliary ink reservoir for holding an auxiliary supply of liquid ink;

an active pump system to pump ink from the auxiliary ink reservoir under positive pressure upon command in response to an electrical pump trigger signal;

a tubing system connected between the internal reservoir and the auxiliary reservoir for providing a fluid path between the spring bag reservoir and the auxiliary reservoir;

a check valve disposed in the fluid path between the spring bag reservoir and the auxiliary reservoir, the check valve responsive to a differential ink pressure having an associated valve break pressure and adapted to allow ink to flow from the auxiliary reservoir to the internal reservoir through the valve only if the differential ink pressure across the check valve exceeds a predetermined valve break pressure, and to prevent ink flow through the valve when the differential ink pressure is below the valve break pressure, the check valve preventing ink from flowing into the internal reservoir unless the pump system is actively operating to pump ink under pressure; and pump trigger apparatus for producing the electrical pump trigger signal to activate the pump only when the internal supply of ink is low, and thereby pump ink from the auxiliary reservoir through the tubing system and check valve to the internal reservoir to replenish the internal supply of ink within the internal reservoir.

12. The system of claim 11 wherein the pump trigger apparatus includes a pressure switch responsive to a negative pressure of the spring bag reservoir to activate the pump system when a magnitude of the negative pressure exceeds a predetermined negative pressure magnitude.

13. The system of claim 12 wherein the pressure switch is connected to the tubing system between the spring bag reservoir and the check valve.

14. The system of claim 11 wherein the pump trigger apparatus includes electrical circuitry comprising a switch disposed within the ink cartridge, the switch responsive to a relative position of the movable side wall to change switch status when the movable side wall position changes as a result of ink depletion from the internal reservoir to a low ink supply position.

15. The system of claim 14 wherein the switch is a leaf spring switch comprising an electrically conductive region defined on the side wall, and a pair of electrically conductive leaf springs having contact end regions which bear against the conductive region when the internal reservoir is at least partially full, and which break contact with the conductive region when the side wall reaches the low ink supply position.

16. The system of claim 15 wherein said leaf spring switch has a leaf spring open status when said leaf springs break contact with the conductive regions, and wherein the trigger signal is represented by a leaf spring switch open status.

17. The system of claim 15 wherein the cartridge includes a housing surface, said system further including a first electrically conductive contact exposed at the cartridge housing surface and a second electrically conductive contact exposed at the housing surface, a first one of said leaf springs electrically connected to said first contact, and a second one of said leaf spring contacts electrically connected to said second contact.

18. The system of claim 11 further including a controller responsive to the pump trigger signal to issue a pump control signal to the pump system.

19. The system of claim 18 wherein said controller is adapted to control said pump system to cause the pumping of a predetermined volume of ink from the auxiliary reservoir to the internal spring bag reservoir in response to receipt of the pump trigger signal.

20. The system of claim 19 wherein the predetermined volume of ink substantially replenishes the volume of ink within the internal spring bag reservoir to a filled condition.

21. The system of claim 11 wherein the check valve break pressure is between 9 inches of water and 15 inches of water.

22. The system of claim 11 further comprising a supply of ink within said internal reservoir.

23. The system of claim 11 further comprising a supply of ink within said auxiliary reservoir.

24. A method for replenishing an internal supply of ink held within a closed internal ink-jet cartridge reservoir under negative pressure, comprising the following steps:

providing an off-axis auxiliary ink reservoir for holding an auxiliary supply of liquid ink;

providing a closed fluid path between a closed internal reservoir of an inkjet cartridge and the auxiliary reservoir, with a check valve disposed in the fluid path, the internal reservoir holding an internal supply of ink under negative pressure, the check valve having an associated valve break pressure and responsive to a differential ink pressure across the check valve to allow ink to flow through the path to the internal reservoir only if the differential ink pressure exceeds the valve break pressure, and prevents ink flow through the path when the differential ink pressure is below the valve break pressure;

determining when the internal ink supply has been depleted to a low supply condition; and producing an electrical pump trigger signal to activate an ink pump when the internal supply of ink is low and to pump ink from the reservoir through the tubing system and check valve to replenish the internal supply of ink within the internal reservoir.

25. The method of claim 24 wherein the step of determining when the ink supply has been depleted includes the steps of monitoring the negative pressure of the internal reservoir, and determining that the ink supply has been depleted to the low supply condition when the magnitude of the negative pressure exceeds a predetermined negative pressure magnitude.

26. The method of claim 24 wherein the step of determining that the ink supply has been depleted to the low supply condition includes the steps of monitoring the position of a movable side wall comprising the internal reservoir, and indicating that the ink supply has been depleted to the low supply condition when the movable side wall position reaches a low ink supply position.

27. The method of claim 24 further comprising the step of pumping a predetermined volume of ink from the auxiliary reservoir to the internal reservoir in response to the pump trigger signal.

28. The method of claim 27 wherein the predetermined volume of ink substantially replenishes the volume of ink within the internal reservoir to a filled condition.

29. The method of claim 24 further including the step of providing a supply of ink within said auxiliary reservoir.

30. An ink delivery system, comprising:

a cartridge including a print head for ejecting droplets of ink in a controlled fashion to produce an image on a recording medium, and an internal closed reservoir for holding an internal supply of liquid ink under negative pressure;

an off-axis auxiliary ink reservoir for holding an auxiliary supply of liquid ink;

an active pump system to pump ink from the auxiliary ink reservoir under positive pressure upon command;

a tubing system connected between the internal reservoir and the auxiliary reservoir for providing a fluid path between the internal reservoir and the auxiliary reservoir;

a check valve disposed in the fluid path between the internal reservoir and the auxiliary reservoir, the check valve responsive to a differential ink pressure and adapted to allow ink to flow through the valve from the auxiliary reservoir to the internal reservoir only if the differential ink pressure exceeds a predetermined valve break pressure, and to prevent ink flow through the valve from the auxiliary reservoir to the internal reservoir when the differential ink pressure is below the valve break pressure; and pump trigger apparatus for producing a pump trigger signal to activate the pump system when the internal supply of ink is low and to thereby pump ink from the auxiliary reservoir through the tubing system and check valve to replenish the internal supply of ink within the internal reservoir, wherein the internal reservoir comprises a movable side wall, and the pump trigger apparatus includes a switch disposed within the ink cartridge, the switch responsive to a relative position of the movable side wall to change switch status when the movable side wall position changes as a result of ink depletion from the internal reservoir to a low ink supply position, and wherein the switch is a leaf spring switch comprising an electrically conductive region defined on the side wall, and a pair of electrically conductive leaf springs having contact end regions which bear against the conductive region when the internal reservoir is at least partially full, and which break contact with the conductive region when the side wall reaches the low ink supply position.

31. The system of claim 30 said leaf spring switch has a leaf spring open status when said leaf springs break contact with the conductive region, and wherein the trigger signal is represented by a leaf spring switch open status.

32. The system of claim 30 wherein the cartridge includes a housing surface, said system further including a first electrically conductive contact exposed at the cartridge housing surface and a second electrically conductive contact exposed at the housing surface, a first one of said leaf springs electrically connected to said first contact, and a second one of said leaf spring contacts electrically connected to said second contact.

33. A spring-bag ink delivery system, comprising:

a cartridge including a print head for ejecting droplets of ink in a controlled fashion to produce an image on a recording medium, and an internal closed spring bag reservoir for holding an internal supply of liquid ink under negative pressure, said reservoir including a movable side wall and an internal spring for biasing said side wall against a collapsing force as ink is withdrawn from the reservoir and ejected from said print head during printing operations;

an off-axis auxiliary ink reservoir for holding an auxiliary supply of liquid ink;

an active pump system to pump ink from the auxiliary ink reservoir under positive pressure upon command in response to an electrical pump trigger signal;

a tubing system connected between the internal reservoir and the auxiliary reservoir for providing a fluid path between the spring bag reservoir and the auxiliary reservoir;

a check valve disposed in the fluid path between the spring bag reservoir and the auxiliary reservoir, the check valve having an associated valve break pressure and responsive to a differential ink pressure across the check valve, said check valve adapted to allow ink to flow from the auxiliary reservoir to the internal reservoir through the valve only if the differential ink pressure exceeds the valve break pressure, and to prevent ink flow through the valve when the differential ink pressure is below the valve break pressure; and pump trigger apparatus for producing the electrical pump trigger signal to activate the pump when the internal supply of ink is low, and thereby pump ink from the auxiliary reservoir through the tubing system and check valve to the internal reservoir to replenish the internal supply of ink within the internal reservoir, wherein the pump trigger apparatus includes electrical circuitry including a switch disposed within the ink cartridge, the switch responsive to a relative position of the movable side wall to change switch status when the movable side wall position changes as a result of ink depletion from the internal reservoir to a low ink supply position.

34. The system of claim 33 further comprising a supply of ink within said internal reservoir.

35. The system of claim 33 further comprising a supply of ink within said auxiliary reservoir.

* * * * *